US006938894B2

(12) United States Patent
Miller et al.

(10) Patent No.: US 6,938,894 B2
(45) Date of Patent: Sep. 6, 2005

(54) TRANSPORT MECHANISM AND METHOD FOR A MAILING MACHINE

(75) Inventors: John P. Miller, Shelton, CT (US); Damian P. Bianchi, Durham, CT (US)

(73) Assignee: Pitney Bowes Inc., Stamford, CT (US)

( * ) Notice: Subject to any disclaimer, the term of this patent is extended or adjusted under 35 U.S.C. 154(b) by 180 days.

(21) Appl. No.: 10/326,512

(22) Filed: Dec. 19, 2002

(65) Prior Publication Data

US 2004/0119223 A1 Jun. 24, 2004

(51) Int. Cl.[7] ..... B65H 5/02
(52) U.S. Cl. ..... 271/274; 271/275
(58) Field of Search ..... 271/264, 275, 271/198, 274

(56) References Cited

U.S. PATENT DOCUMENTS 4,821,049 A 4/1989 Eckl
6,179,419 B1 1/2001 Rasmussen et al.
6,431,778 B1 8/2002 Coudray et al.

*Primary Examiner*—Donald P. Walsh
*Assistant Examiner*—Kaitlin Joerger
(74) *Attorney, Agent, or Firm*—Brian A. Lemm; Angelo N. Chaclas

(57) ABSTRACT

A top registration transport mechanism and method for a mailing machine is provided. The transport mechanism includes one or more displaceable rollers that have a diameter larger than the drive/idler rollers. A semi-elastic belt is looped around the drive/idler rollers and displaceable rollers. The larger diameter of the displaceable rollers causes a portion of the transport belt in the area of the displaceable rollers to be slightly raised. The registration plate can contact the raised portion of the belt to displace the belt and displaceable rollers, thereby ensuring that very thin mail pieces can be effectively processed by the transport. As thicker mail pieces traverse the transport, the displaceable rollers can be further displaced before the entire transport mechanism must be displaced to maintain registration of the mail piece against the bottom of the registration plate.

21 Claims, 4 Drawing Sheets

TRANSPORT MECHANISM AND METHOD FOR A MAILING MACHINE

FIELD OF THE INVENTION

The invention disclosed herein relates generally to mailing systems, and more particularly to a mailing machine transport mechanism and method.

BACKGROUND OF THE INVENTION

Mailing systems, such as, for example, a mailing machine, often include different modules that automate the processes of producing mail pieces. The typical mailing machine includes a variety of different modules or subsystems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering/printing module, i.e., applying evidence of postage to the mail piece. The exact configuration of the mailing machine is, of course, particular to the needs of the user.

Modern mailing machines utilize digital printing techniques for producing images on a mail piece being processed therethrough. Conventional digital printing techniques include bubble jet and ink jet, each of which produces an image in a dot matrix pattern. With digital printing, individual print head elements (such as resistors or piezoelectric elements) are selectively electronically stimulated to expel drops of ink from a reservoir onto a substrate, e.g., a mail piece. In either case, by controlling the timing of energizing of the individual print head elements in conjunction with the relative movement between the print head and the mail piece, a dot matrix pattern is produced in the visual form of the desired indicia, i.e., the evidence of postage.

Digital printing technology has significant advantages when used in a mail handling apparatus as compared to older technology that utilized either a flat platen or a rotary drum to imprint indicia on mail pieces. For example, if the variable indicia image data needs to be changed, it can easily be done through the installation of new or upgraded software versus having to replace the entire meter, since the flat platen and drum are typically not separately removable. Moreover, greater printing speeds can be obtained as compared to conventional mechanical printing systems. However, the use of a digital print head in a mail handling apparatus presents other issues that must be taken into consideration. For example, for the ink jet nozzles of an ink jet printer to properly deposit ink on the surface of the receiving medium, it is critical that a small predetermined gap be maintained between the exit plane of the nozzles and the surface of the receiving medium, typically in the order of one sixteenth to one thirty-second of an inch. This gap is necessary to achieve acceptable image quality, since too small a gap causes scuffing of the print head and to large a gap results in inaccurate dot placement, with either situation resulting in a deteriorated print image. Thus, in the mailing machine environment, it becomes necessary to maintain this critical gap between the exit plane of the ink jet nozzles and the upper surface of the mail pieces being conveyed through the mailing machine.

To accomplish this, the mail pieces, such as, for example, envelopes, postcards, flats, and the like, must be conveyed with the front panels on which the postage indicia is printed lying in a fixed registration plane, which is disposed beneath the exit plane of the nozzles a distance equal to the aforementioned gap. This arrangement is referred to hereinafter as top registration. The problem that arises, however, with top registration is that the plane of the rear panel of the mail piece is not fixed, as is the case with bottom registration, but rather must shift vertically in accordance with variations in the thickness of the mail pieces being conveyed through the mailing machine. Thus, even with top registration, the mailing machine must be capable of accepting mail pieces of varying thickness.

FIGS. 1 and 2 illustrate a portion of a conventional mailing machine, including a transport mechanism 10, that provides top registration of a mail piece. Transport 10 includes a support bracket 12 coupled to a support spring 14. One or more drive/idler rollers 16 are mounted to the support bracket 12. A belt 18 is looped around the drive/idler rollers 16. At least one drive roller 16 is coupled to a motor (not shown) that controls rotation of the drive roller 16, and hence movement of the belt 18. A registration plate 20 is situated above the belt 18. A print head 22 is mounted adjacent to the registration plate 20, situated over an opening (not shown) in the registration plate 20. Spring 14 maintains a biasing force on support bracket 12, and hence the belt 18, in the direction of the registration plate 20. As a mail piece 30 is transported by the movement of the belt 18 in the gap between the belt 18 and the bottom surface of the registration plate 20, the mail piece 30 is kept registered against the bottom surface of registration plate 20 by the force exerted from spring 14, thereby fixing the distance between the print head 22 and the top surface of the mail piece 30.

Excessive drag between the belt 18 and the bottom surface of the registration plate 20 is prevented by limiting the amount of movement of the support bracket 12 in the upward direction by a pair of adjustable up-stops 24. The adjustment of the up-stops 24 is critical, as the gap between the belt 18 and the registration plate 20 must be small enough to run card stock yet large enough to prevent the belt 18 from contacting the registration plate 20 when no card stock is present.

Most mailing machines are typically designed to handle mail pieces of different thickness, such as, for example, from card stock up to three-quarters of an inch thick. As such, the transport 10 must be displaceable to accommodate the thicker mail pieces. As a thicker mail piece is transported by the transport 10, the spring 14 will compress (as illustrated in FIG. 2), thereby allowing the mail piece to pass between the belt 18 and the registration plate 20, while still maintaining the registration of the mail piece against the bottom surface of the registration plate 20. Compression of the spring 14 will cause a small gap 40 between the support bracket 12 and the up-stops 24.

There are problems, however, with the conventional top registration transports such as transport 10. First, the transport 10, including the support bracket 12 and drive/idler rollers 16, is relatively large and heavy. Thus, the spring 14 must be strong enough to lift both the transport 10, along with a heavy mail piece, to ensure proper registration of the mail piece along the bottom surface of the registration plate 20. This makes it extremely difficult to provide fine adjustments to the gap. If the belt 18 make contact with the registration plate 20, the amount of friction between the two, caused by the force of spring 14, could damage the motor driving the belt 18 or even prevent the belt 18 from moving at all. It is thus necessary to always maintain the small gap between the belt 18 and registration plate 20 to prevent such damage to the motor or immobilization of the belt 18.

Second, when a thick mail piece exits the transport 10, the spring 14 will decompress until the support bracket 12 contacts the up-stops 24. Generally, this decompression and resulting movement of the support bracket 12 is both quick and forceful, causing a severe shock on the up-stops 24 and transport 10 when the support bracket 12 makes contact. The amount of displacement of the transport 10, and corresponding shock to the up-stops 24 and transport 10 upon return to its original position, increases as the mail piece thickness increases. The sudden decompression of spring 14 causes several problems. First, the noise associated with the support bracket 12 making contact with the up-stops 24 is substantial. Due to the fine adjustment required to maintain the small gap between the belt 18 and registration plate 20, it is not possible to provide any type of damping material to reduce the amount of noise, as any dampening material may deform over time, thereby decreasing the gap and allowing the belt 18 to make contact with the registration plate 20. As noted above, this is not an acceptable situation. In addition, the repeated force with which the transport bracket 12 contacts the up-stops 24 will, over time, affect the gap between the belt 18 and registration plate 20. It is therefore necessary to frequently perform maintenance on the transport 10 to re-adjust the up-stops 24, thereby ensuring that the gap between the belt 18 and the registration plate 20 is small enough to run card stock yet large enough to prevent the belt 18 from contacting the registration plate 20 when no card stock is present. This necessary maintenance increases the cost of owning a mailing machine, as well as increases the down time, i.e., time which the machine cannot be used. If the maintenance is not performed regularly to properly maintain the gap, the transport 10 may become inoperable if the gap has decreased (due to the unacceptable amount of friction between the belt 18 and registration plate 20), or may not properly register thin mail pieces, such as card stock, if the gap has increased. Either of these situations will result in dissatisfaction with the mailing machine.

Thus, there exists a need for a top registration transport that can effectively handle mail pieces of different thickness while alleviating the problems of the conventional transports.

SUMMARY OF THE INVENTION

The present invention alleviates the problems associated with the prior art and provides a transport mechanism and method that provides top registration for mail pieces that can effectively handle mail pieces of different thickness. The present invention effectively eliminates the criticality of maintaining the small gap between the belt and registration plate, reduces the occurrence of the spring compressing, and, should the spring compress, reduces the amount of noise and shock associated with the subsequent decompression of the spring.

In accordance with the present invention, a top registration transport mechanism is provided that includes one or more additional rollers that are coupled to the drive/idler rollers for the transport belt by pivotable links. A semi-elastic belt is looped around the drive/idler rollers and additional rollers. The transport mechanism includes a support bracket that is coupled to a spring, which maintains a biasing force on the support bracket in the direction of a registration plate. The amount of movement of the support bracket is limited by one or more up-stops, which preferably are provided with a damping material. The additional rollers have a diameter that is larger than the drive/idler rollers, causing a portion of the transport belt in the area of the additional rollers to be slightly raised. The registration plate above the transport can contact the raised portion of the belt to displace the belt and additional rollers, thereby ensuring that very thin mail pieces, such as, for example, card stock, can be effectively processed by the transport. Because the mass of the displaced components is very small as compared with the mass of the entire transport, the amount of friction between the belt and registration plate, when no mail piece is present, is limited to an acceptable value. As a mail piece traverses the transport, the additional rollers are further displaced, and registration of the mail piece against the bottom of the registration plate is maintained by the force of the belt acting to return the additional rollers to their original position. If a mail piece that is thicker than the difference between the diameter of the additional rollers and drive/idler rollers is processed by the transport, the force will displace the support bracket and compress the spring. When the mail piece exits and the spring decompresses, the damping material that is provided on the up-stops reduces the shock and noise associated with the support bracket contacting the up-stops.

Thus, according to the present invention, the criticality of maintaining the small gap between the belt and registration plate is significantly decreased, as the amount of friction between the belt and registration plate is limited to an acceptable value. Additionally, the compression of the spring supporting the entire transport mechanism will not occur unless the mail piece is a thick mail piece, i.e., the thickness of the mail piece is greater than the difference between the diameter of the additional rollers and the drive/idler rollers. Thus, a large portion of mail pieces can be handled by the transport of the present invention without having to displace the support bracket by compressing the spring. This results in less wear on the transport due to the decrease in shock to the support bracket, up-stops and surrounding components, since the number of times the spring will be compressed and subsequently decompress will be significantly reduced. This also significantly reduces the amount of noise generated by the transport when processing mail pieces. Another advantage is that since the criticality of maintaining the gap between the belt and registration plate is reduced, the up-stops can be provided with a damping material. Accordingly, even when the support bracket is displaced by compression of the spring due to a thick mail piece, when the mail piece exits the transport and the spring decompresses, the resulting noise and shock can be significantly reduced.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate a presently preferred embodiment of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 3:
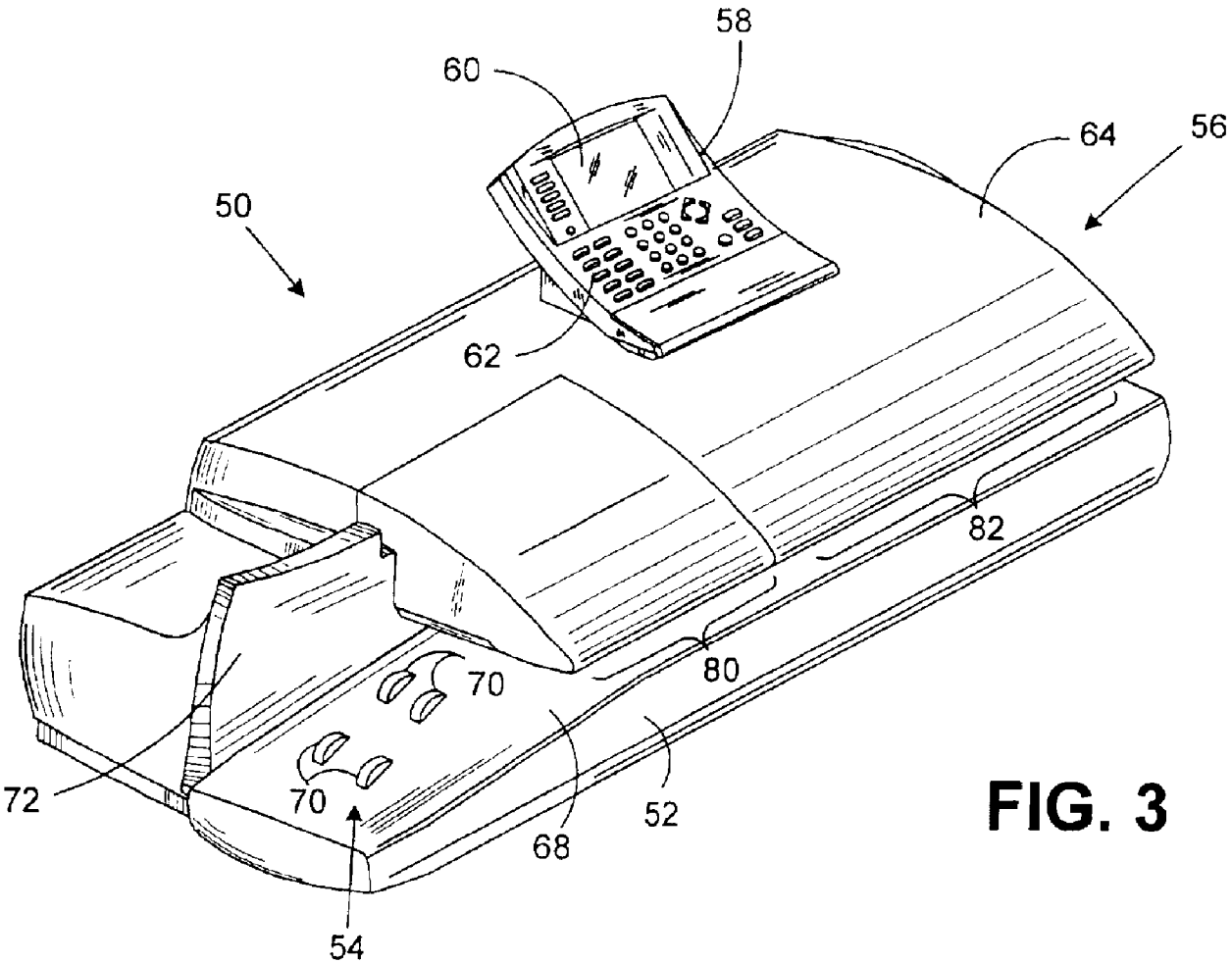
FIG. 3 illustrates a mailing machine having a transport according to the present invention.

In describing the present invention, reference is made to the drawings, wherein there is seen in FIG. 3 a mailing machine 50 that includes a transport mechanism according to the present invention. Mailing machine 50 comprises a base unit, designated generally by the reference numeral 52, the base unit 52 having a mail piece input end, designated generally by the reference numeral 54 and a mail piece output end, designated generally by the reference numeral 56. A control unit 58 is mounted on the base unit 52, and includes one or more input/output devices, such as, for example, a keyboard 62 and a display device 60. One or more cover members 64 are pivotally mounted on the base 52 so as to move from the closed position shown in FIG. 3 to an open position (not shown) so as to expose various operating components and parts for service and/or repair as needed.

The base unit 52 further includes a horizontal feed deck 68 which extends substantially from the input end 54 to the output end 56. A plurality of nudger rollers 70 are suitably mounted under the feed deck 68 and project upwardly through openings in the feed deck so that the periphery of the rollers 70 is slightly above the upper surface of the feed deck 68 and can exert a forward feeding force on a succession of mail pieces placed in the input end 54. A vertical wall 72 defines a mail piece stacking location from which the mail pieces are fed by the nudger rollers 70 along the feed deck 68. The mail pieces may be passed through one or more modules, such as, for example, a singulator module (not shown) and moistening/sealing module. Each of these modules is located generally in the area indicated by reference numeral 80. The mail pieces are then passed to a metering/printing module located generally in the area indicated by reference numeral 82.

Figure 4:
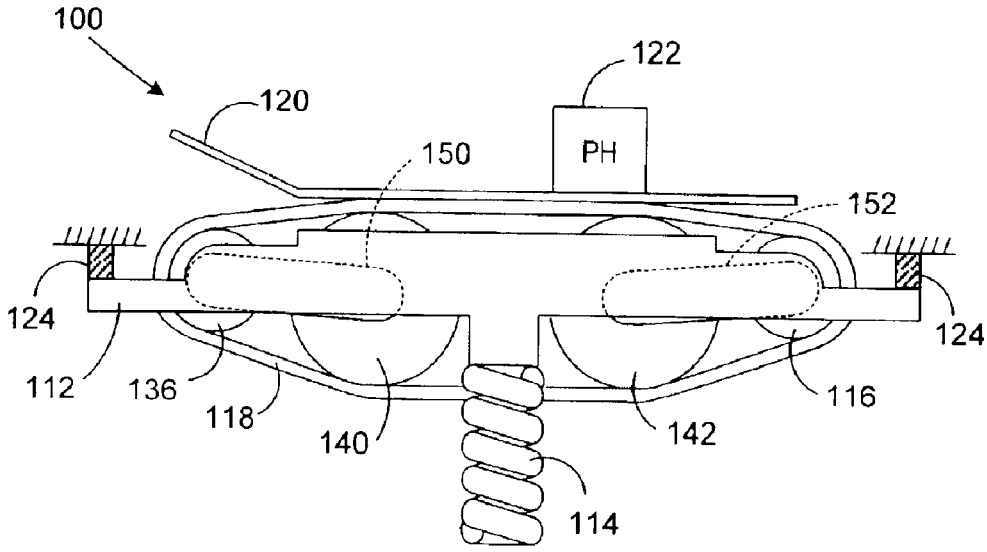
FIG. 4 illustrates a side view of a top registration transport mechanism according to the present invention.

Referring now to FIG. 4, there is illustrated a side view of a portion of a transport mechanism 100 according to the present invention. Transport mechanism 100 could be used, for example to transport a mail piece through the metering/printing module of mailing machine 50. Transport mechanism 100 provides top registration of a mail piece and passes the mail piece past a print head 122 for printing thereon. Transport 100 includes a support bracket 112 coupled to a support spring 114. A drive roller 116 is mounted near a first end of the support bracket 112. Drive roller 116 is coupled to a motor (not shown) that controls rotation of the drive roller 116. An idler roller 136 is mounted to the support bracket 112 near the end opposite drive roller 116. The rollers 116, 136 are fixedly mounted to the support bracket, i.e., they rotate about a fixed shaft. According to the present invention, a pair of displaceable idler rollers 140, 142 are provided between the drive roller 116 and idler roller 136. The shaft of idler roller 140 is coupled to the shaft of idler roller 136 via pivotable link 150, and the shaft of idler roller 142 is coupled to the shaft of drive roller 146 via pivotable link 152. Alternatively, the idler rollers 140, 142 could be pivotally mounted directly to the support bracket 112 or mounted in a vertical channel in the support bracket 112. Thus, the rollers 140, 142 can rotate or move vertically, i.e., the shaft of rollers 140, 142 is not fixed and can move with respect to the support bracket 112. Rollers 140, 142 preferably have a diameter that is greater than the diameter of rollers 116, 136, and protrude through slots in the top of the support bracket 112. Thus, the portion of the belt 118 located between the rollers 140, 142 will be raised slightly higher, due to the difference in diameter of rollers 140, 142 and rollers 116, 136, than the portion of the belt 118 nearest the rollers 116, 136. Rollers 140, 142 are preferably formed from plastic or other lightweight material. The pivoting motion of links 150, 152 allow the rollers 140, 142 to float with respect to the support bracket 112 and rollers 116, 136. A belt 118 is looped around the rollers 116, 136, 140, 142. Belt 118 is preferably a semi-elastic belt, and therefore will act to maintain the center of the rollers 136, 116, 140 and 142 parallel to each other in the same plane (not shown), referred to herein as the rest position. A registration plate 120 is situated above the belt 118. A print head 122 is mounted adjacent to the registration plate 120, situated over an opening (not shown) in the registration plate 120. Spring 114 maintains a biasing force on support bracket 112, and hence the belt 118, in the direction of the registration plate 120. The amount of movement of the support bracket 112 in the upward direction is limited by a pair of up-stops 124. Preferably, up-stops 124 are adjustable and are provided with a damping material, such as, for example, rubber. As a mail piece (not shown) is transported by the movement of the belt 118 in the gap between the belt 118 and the bottom surface of the registration plate 120, the mail piece is kept registered against the bottom surface of registration plate 120 as described below, thereby fixing the distance between the print head 22 and the top surface of the mail piece.

As previously noted, in conventional top registration transport mechanisms, the gap between the belt and registration plate is critical, as it must be small enough to run card stock yet large enough to prevent excessive friction between the belt and the registration plate. The transport 100 of the present invention effectively eliminates any gap between the belt 118 and registration plate 120 while limiting any frictional drag between the belt 118 and registration plate 120 to a minimal acceptable amount. This is accomplished by the operation of the floating rollers 140, 142 in conjunction with the belt 118. As illustrated in FIG. 4, the home position, i.e., no mail piece present, of support bracket 112 can be set utilizing up-stops 124 such that the pivotable links 150, 152 are slightly off horizontal. The position of pivotable links 150, 152 is due to the belt 118 making contact with the registration plate 120, thereby providing a downward force on the rollers 140, 142 and displacing the rollers 140, 142, causing the rollers 140, 142 to pivot slightly via links 150, 152. As illustrated in FIG. 4, the centers of the rollers 140, 142 are slightly lower than the centers of the rollers 116, 136 due to the displacement of the rollers 140, 142. Thus, in the home position, the belt 118 will contact the bottom surface of the registration plate 120. However, because the mass of the displaced components, i.e., rollers 140, 142, links 150, 152 and belt 118, is very small as compared with the mass of the entire transport 100, the amount of friction between the belt 118 and registration plate 120 is limited to an acceptable value, i.e., the amount of frictional torque on the motor (not shown) that is driving the drive roller 116 is such that it will not have any detrimental effects on the motor.

Figure 5:
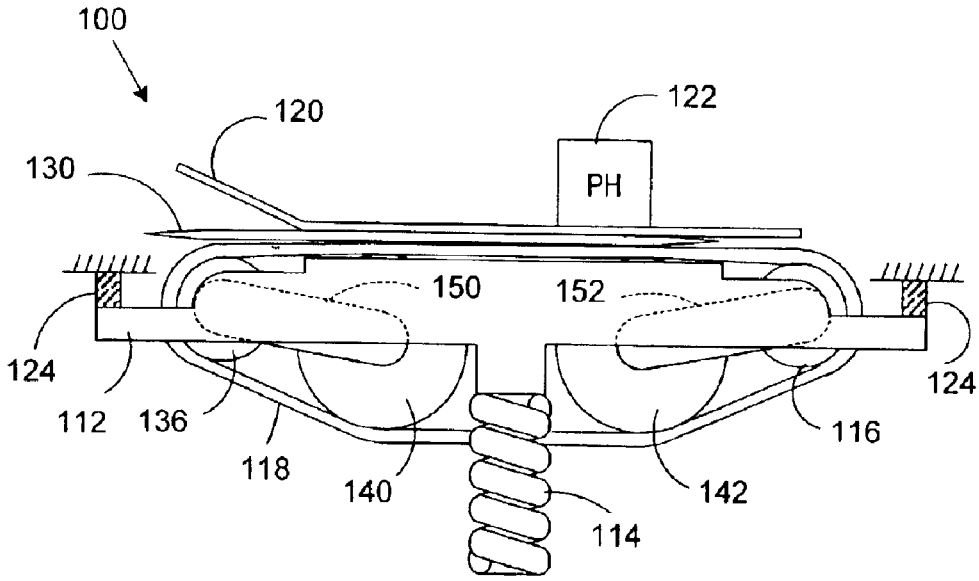
FIG. 5 illustrates a mail piece being transported by the transport mechanism of the present invention.

The operation of transport 100, when transporting mail pieces of different thickness, will now be described with respect to FIGS. 5 and 6. Referring now to FIG. 5, there is illustrated a "thin" mail piece 130 being transported by the transport 100 of the present invention. A "thin" mail piece, for purposes of this specification, is defined as a mail piece that has a thickness that is approximately equal to or less than the difference between the diameter of the rollers 140, 142 and rollers 116, 136. As the mail piece 130 enters between the registration plate 120 and the belt 118, the mail piece 130 will exert a downward force on the belt 118, thereby causing the rollers 140, 142 to pivot downward via pivoting links 150, 152. Mail piece 130 will maintain registration against the bottom surface of registration plate 120 due to the force of belt 118 acting to return the rollers 140, 142 to the rest position. When the mail piece 130 exits the transport 100, the rollers 140, 142 will return to the home position as illustrated in FIG. 4, due top the semi-elasticity of belt 118, to await the next mail piece.

Figure 6:
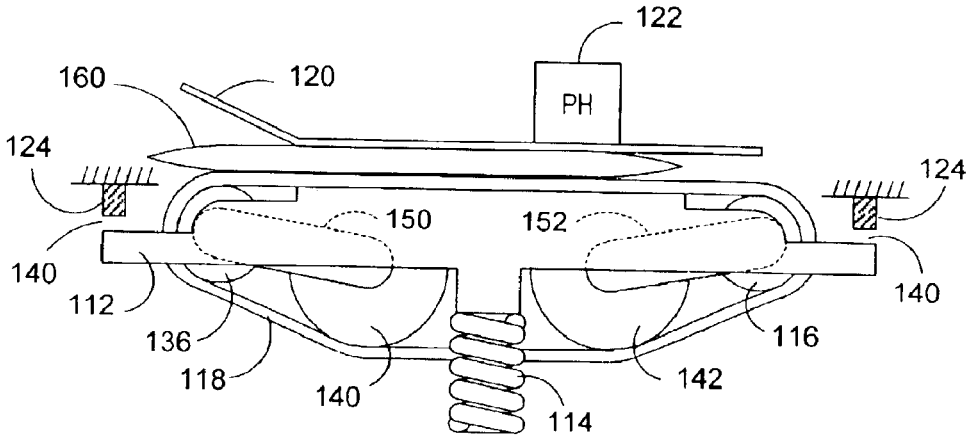
FIG. 6 illustrates a thick mail piece being transported by the transport mechanism of the present invention.

Referring now to FIG. 6, there is illustrated a mail piece 160 being transported by the transport 100 of the present invention. Mail piece 160 is a "thick" mail piece, i.e., the thickness of mail piece 160 is greater than the difference between the diameter of the rollers 140, 142 and rollers 116, 136. As the mail piece 160 enters between the registration plate 120 and the belt 118, the mail piece 160 will exert a downward force on the belt 118, thereby causing the rollers 140, 142 to pivot downward via pivoting links 150, 152. When the links 150, 152 have pivoted such that the tops of the rollers 140, 142 are in the same horizontal plane as the tops of rollers 116, 136, any additional force exerted by the mail piece 160 will cause the bottom of the belt 118 to contact the top of the support bracket 112. The force of the belt 118 contacting the support bracket 112 will cause the spring 114 to compress. The compression of the spring 114 allows the mail piece 160 to pass between the belt 118 and the registration plate 120, while still maintaining the registration of the mail piece 160 against the bottom surface of the registration plate 120. Compression of the spring 114 will cause a small gap 140 between the support bracket 112 and the up-stops 124. Mail piece 160 will maintain proper registration against the bottom surface of registration plate 120 due to the force exerted by the compressed spring 114. When the mail piece 160 exits the transport 100, the spring 114 will decompress until the support bracket 112 contacts the up-stops 124 and the rollers 140, 142 will return to the home position (due to the force from belt 118) to await the next mail piece. The damping material on up-stops 124 will absorb some of the contact force of the support bracket 112, thereby reducing the shock and noise when the support bracket 112 contacts the up-stops 124.

Figure 1:
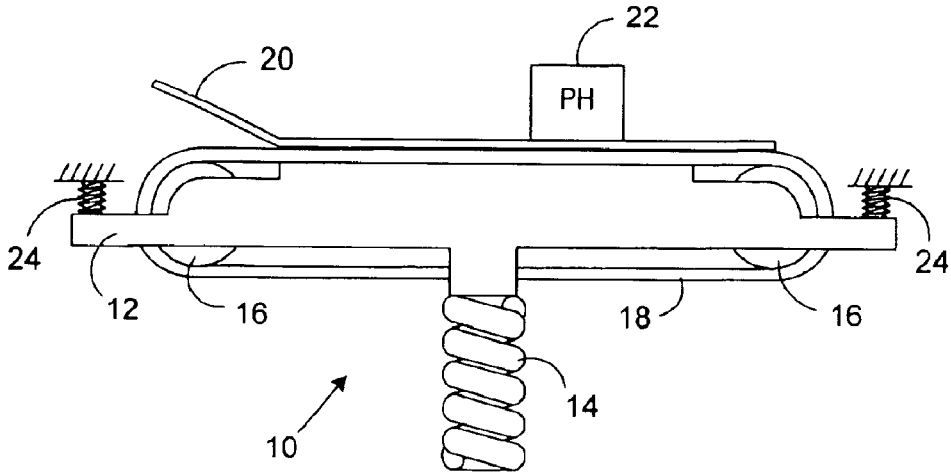
FIG. 1 ( PRIOR ART )
FIG. 1 illustrates a side view of a conventional transport mechanism that provides top registration of a mail piece.
Figure 2:
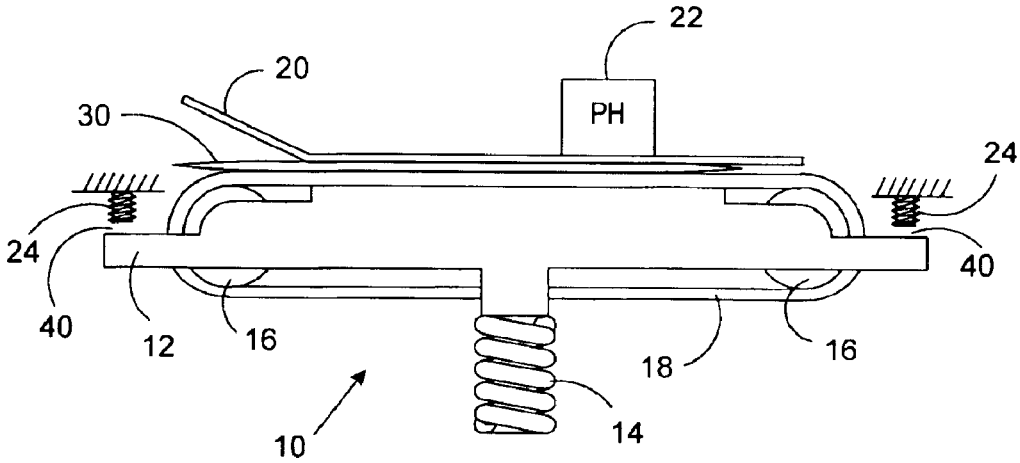
FIG. 2 ( PRIOR ART )
FIG. 2 illustrates a mail piece being transported by the conventional transport mechanism of FIG. 1.

The transport 100 has several advantages over conventional transports, such as transport 10 illustrated in FIGS. 1 and 2. First, the criticality of maintaining the small gap between the belt 118 and registration plate 120 is significantly decreased. As noted above, even if the belt 118 makes contact with the registration plate 120 (a situation that was not tolerable in conventional transports), the amount of friction between the belt 118 and registration plate 120 is limited to an acceptable value, i.e., the amount of frictional torque on the motor (not shown) that is driving the drive roller 116 is such that it will not have any detrimental effects on the motor. Thus, the gap spacing between the belt 118 and registration plate 120 is not as critical, and must be maintained only to a point such that the belt 118 is not being pressed against the registration plate 120 by the force of spring 114. Additionally, the compression of spring 114 will not occur unless the mail piece is a thick mail piece, i.e., the thickness of mail piece 160 is greater than the difference between the diameter of the rollers 140, 142 and rollers 116, 136. Thus, a large portion of mail pieces can be handled by the transport 100 without having to displace the support bracket 112 by compressing the spring 114. This results in less wear on the transport 100 due to the decrease in shock to the support bracket 112, up-stops 124 and surrounding components, since the number of times the spring 114 will be compressed and subsequently decompress will be significantly reduced. This also significantly reduces the amount of noise generated by the transport 100 when processing mail pieces. Another advantage is that since the criticality of maintaining the gap between the belt 118 and registration plate 120 is reduced, the up-stops 124 can be provided with a damping material. Accordingly, even when the support bracket 112 is displaced by compression of the spring 114 due to a thick mail piece, when the mail piece exits the transport 100 and the spring 114 decompresses, the resulting noise and shock can be significantly reduced.

Figure 7:
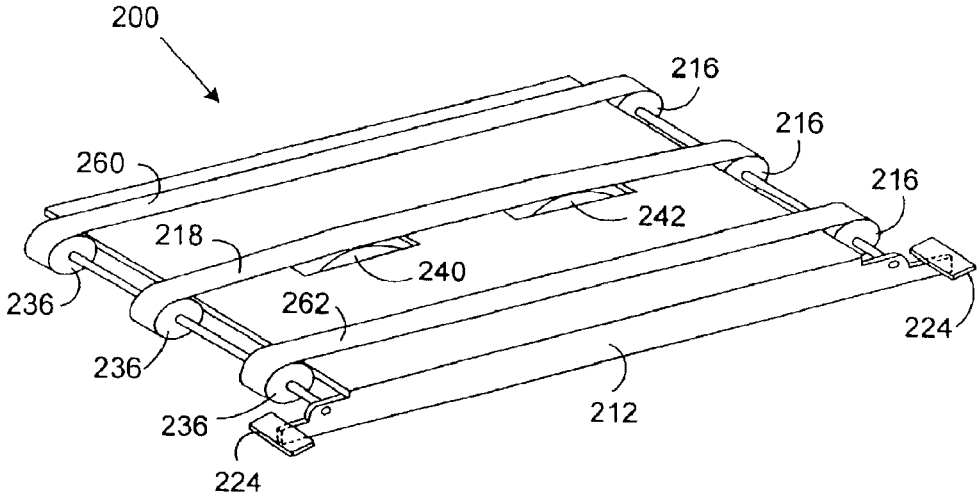
FIG. 7 illustrates a top view of a transport mechanism according to an alternative embodiment of the present invention that includes multiple belts.

Referring now to FIG. 7, there is illustrated a top view of a transport 200, with the registration plate removed, according to another embodiment of the present invention. Transport 200 is similar to transport 100 except that it utilizes multiple belts as described below. Transport 200 includes a support bracket 212 coupled to a support spring (not shown) similarly as described with respect to support bracket 112 and spring 114 of transport 100. The transport 200 includes a plurality of parallel, spaced part drive rollers 216 and idler rollers 236. A respective belt 260, 218, 262 is looped around each respective drive roller 216 and idler roller 236 pair. Drive rollers 216 are coupled to a motor (not shown) that controls rotation of the drive rollers 216. According to the present invention, a pair of idler rollers 240, 242 are provided between the drive roller 216 and idler roller 236 of belt 218. Rollers 240, 242, similarly to rollers 140, 142 of transport 100, are coupled to the rollers 236, 216 with pivotable links (not shown) similarly as described for links 150, 152 of transport 100. Belt 218 is preferably a semi-elastic belt. The amount of movement of the support bracket 212 in the upward direction is limited by a pair of up-stops 224 similar to up-stops 124.

The operation of the transport 200 is as follows. Belt 218 operates in substantially the same manner as belt 118 described with respect to FIGS. 5 and 6 and will not be repeated fully here. It is important to note that the level of belt 218 is raised above the level of the belts 260, 262 by the rollers 240, 242. Thus, in the home position of transport 200, only the belt 218 will contact the bottom of the registration plate (not shown), thereby reducing the frictional drag to an acceptable amount as previously described. Belts 260, 262 do not contact the bottom of the registration plate (not shown), and therefore do not contribute to any frictional torque on the motor driving the drive rollers 216. For thin mail pieces, top registration is provided by the belt 218 similarly as described with respect to belt 118 for FIG. 5, while the other belts 260, 262 do not contribute any forces to maintain the registration of the mail piece. For a thick mail piece, once the rollers 240, 242 have pivoted downward from the force of the mail piece such that the belt 218 is at the same level as the belts 260, 262, the belts 260, 262 will engage the thick mail piece. Any additional force from the mail piece will cause the bottom of the belts 260, 262, 218 to contact the top of the support bracket 212. The force of the belts 260, 262, 218 contacting the support bracket 212 will cause the support spring (not shown) to compress similarly as described with respect to transport 100 for FIG. 6. Thus, for a thick mail piece, all of the belts 260, 218, 262 will engage the mail piece and the support bracket 212 will be displaced. The mail piece will maintain proper registration against the bottom surface of the registration plate due to the force exerted by the compressed support spring. When the mail piece exits the transport 200, the support spring will decompress until the support bracket 212 contacts the up-stops 224 and the rollers 240, 242 will return to the home position (due to the force from belt 218) to await the next mail piece. The damping material on up-stops 224 will absorb some of the contact force of the support bracket 212, thereby reducing the shock and noise when the support bracket 212 contacts the up-stops 224.

Thus, according to the present invention, a top registration transport system and method that can effectively handle mail pieces of different thickness is provided. The transport mechanism of the present invention effectively eliminates the criticality of maintaining the small gap between the belt and registration plate, reduces the occurrence of the spring compressing, and, should the spring compress, reduces the amount of noise and shock associated with the subsequent decompression of the spring.

Those skilled in the art will also recognize that various modifications can be made without departing from the spirit of the present invention. For example, while the present invention has been described with two additional idler rollers, the invention is not so limited and any number of additional idler rollers could be provided. As another example, for transport mechanisms that utilize multiple belts, more than one belt can be looped around respective additional idler rollers, as long as the combined frictional force of each of the belts that make contact with the registration plate is with an acceptable amount.

While preferred embodiments of the invention have been described and illustrated above, it should be understood that they are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A transport mechanism for a mailing machine, the transport mechanism registering a face of a mail piece against a bottom surface of a registration plate, the transport mechanism comprising:

a support bracket;

a support spring coupled to the support bracket, the support spring providing a biasing force on the support bracket in a first direction towards the registration plate;

at least one up-stop to limit movement of the support bracket in the first direction;

a first roller and a second roller, each having a first diameter, the first roller being located near a first end of the support bracket, the second roller being located near a second end of the support bracket;

a first idler roller and a second idler roller located between the first and second rollers, each of the first and second idler rollers having a second diameter greater than the first diameter, the first and second idler rollers being displaceable with respect to the support bracket; and a semi-elastic belt looped around the first roller, second roller, first idler roller and second idler roller, a portion of the bottom surface of the registration plate contacting a portion of the semi-elastic belt between the first idler roller and the second idler roller.

2. The transport mechanism according to claim 1, wherein the contact between the portion of the bottom surface of the registration plate and the portion of the semi-elastic belt causes the first idler roller and the second idler roller to displace to a home position, and when a mail piece, having a thickness not greater than a difference between the second and first diameter, is being transported by the semi-elastic belt, the first idler roller and the second idler roller further displace from the home position to another position and a face of the mail piece is held against the bottom surface of the registration plate by the semi-elastic belt acting to maintain the first idler roller and second idler roller in the home position.

3. The transport mechanism according to claim 1, wherein when a mail piece being transported by the semi-elastic belt causes the first idler roller and the second idler roller to displace until a top of the first idler roller and second idler roller are at approximately a same level as a top of the first and second rollers, the support spring compresses, and a face of the mail piece is held against the bottom surface of the registration plate by the biasing force provided by the spring in the first direction towards the registration plate.

4. The transport mechanism according to claim 3, wherein when the support spring compresses, a gap is established between the support bracket and the at least one up-stop.

5. The transport mechanism according to claim 4, wherein the at least one up-stop includes a damping material, the support bracket contacting the damping material when the spring decompresses to eliminate the gap.

6. The transport mechanism according to claim 5, wherein the damping material is rubber.

7. The transport mechanism according to claim 1, further comprising:

a first pivotable link coupled to the first idler roller; and a second pivotable link coupled to the second idler roller, wherein the first and second idler rollers are displaceable by pivoting of the links.

8. The transport mechanism according to claim 7, wherein the first pivotable link is coupled to a shaft of the first idler roller on a first end, and to a shaft of the first roller on a second end.

9. The transport mechanism according to claim 8, wherein the second pivotable link is coupled to a shaft of the second idler roller on a first end, and to a shaft of the second roller on a second end.

10. The transport mechanism according to claim 1, further comprising:

a third roller and a fourth roller, each having the first diameter, the third roller being located near the first end of the support bracket parallel to and spaced apart from the first roller, the fourth roller being located near the second end of the support bracket parallel to and spaced apart from the second roller; and a second belt looped around the third and fourth rollers, wherein when a mail piece being transported by the semi-elastic belt causes the first idler roller and the second idler roller to displace until a top of the first idler roller and second idler roller are at approximately a same level as a top of the first and second rollers, the mail piece contacts the second belt and the support spring compresses, and a face of the mail piece is held against the bottom surface of the registration plate by the biasing force provided by the spring in the first direction towards the registration plate.

11. The transport mechanism according to claim 10, wherein when a mail piece having a thickness not greater than a difference between the second and first diameter is being transported by the semi-elastic belt, the mail piece will not contact the second belt and a face of the mail piece is held against the bottom surface of the registration plate by the semi-elastic belt acting to maintain the first idler roller and second idler roller in a home position.

12. A mailing machine for printing on an upper surface of a mail piece passing through the mailing machine, the mailing machine comprising:

a printing device including a print head having a plurality of nozzles disposed in a predetermined plane to deposit ink on the upper surface of a mail piece;

a registration device to register the upper surface of a mail piece at a predetermined distance beneath the plurality of nozzles; and a transport device to transport a mail piece under the plurality of nozzles, the transport device further maintaining registration of the upper surface of a mail piece against the registration device, the transport device comprising:

a support bracket coupled to a support spring, the support spring providing a biasing force on the support bracket in a direction towards the registration device;

at least one up-stop to limit movement of the support bracket in the direction towards the registration device, the up-stop including a damping material;

a first and second roller, each having a first diameter, the first roller located near a first end of the support bracket and the second roller located near a second end of the support bracket;

at least one idler roller located between the first and second rollers, the at least one idler roller having a second diameter greater than the first diameter, the at least one idler roller being displaceable with respect to the support bracket; and a semi-elastic belt looped around the first, second and the at least one idler roller, the semi-elastic belt contacting at least a portion of a bottom surface of the registration device near the at least one idler roller when no mail piece is present, the contact between the registration device and the semi-elastic belt causing the at least one idler roller to displace to a home position, wherein when a mail piece, having a thickness not greater than a difference between the second and first diameter, is being transported by the semi-elastic belt, the at least one idler roller is further displaced from the home position to another position and the upper surface of the mail piece is held against the bottom surface of the registration device by the semi-elastic belt acting to maintain the at least one idler roller in the home position, and wherein when a mail piece being transported by the semi-elastic belt causes the at least one idler roller to displace until a top of the at least one idler roller is at approximately a same level as a top of the first and second rollers, the support spring compresses, and a face of the mail piece is held against the bottom surface of the registration device by the biasing force provided by the support spring.

13. The mailing machine according to claim 12, wherein the at least one idler roller further comprises:

a first idler roller and a second idler roller, the first idler roller being coupled to the first roller and the second idler roller being coupled to the second roller.

14. The mailing machine according to claim 12, wherein the transport device further comprises:

a second belt looped around a third and fourth roller, the third and fourth roller having the first diameter, the second belt not contacting the bottom surface of the registration device when no mail piece is present.

15. The mailing machine according to claim 12, wherein the damping material is rubber.

16. A method for a transport device to register a surface of a mail piece against a registration plate in a mailing machine comprising:

passing the mail piece between a semi-elastic belt and a bottom surface of the registration plate, the semi-elastic belt being looped around a drive roller and a first idler roller having a first diameter and a second and third idler roller having a second diameter greater than the first diameter, the semi-elastic belt contacting the bottom surface of the registration plate when no mail piece is present;

displacing the second and third idler rollers for a mail piece having a first thickness, the first thickness being not greater than a difference between the second diameter and the first diameter;

holding the surface of the mail piece having the first thickness against the bottom surface of the registration device by the semi-elastic belt acting to maintain the second and third idler rollers in a home position;

further displacing the second and third idler rollers and then displacing the transport device by compressing a spring supporting the transport device for a mail piece having a second thickness, the second thickness being greater than the difference between the second diameter and the first diameter; and holding the surface of the mail piece having the second thickness against the bottom surface of the registration device by a force exerted by the compressed spring on the transport device in a direction toward the registration device.

17. The method of claim 16, further comprising:

returning the second and third idler rollers to the home position after a mail piece having either the first or second thickness has exited the transport device.

18. The method of claim 16, further comprising:

limiting movement of the transport device in the direction toward the registration device by at least one up-stop, the up-stop including a damping material.

19. The method of claim 18, wherein if the spring has compressed, the method further comprises:

decompressing the spring until the transport device contacts the damping material of the at least one up-stop.

20. The method of claim 16, wherein for a mail piece having the second thickness, the method further comprises:

contacting a second belt after the second and third idler rollers have been further displaced.

21. The method of claim 20, wherein the second belt does not contact the bottom surface of the registration plate when no mail piece is present.

* * * * *